US008932411B2

(12) United States Patent
Beaudet et al.

(10) Patent No.: US 8,932,411 B2
(45) Date of Patent: Jan. 13, 2015

(54) METHOD FOR CONTROLLING ZONAL WASHING IN A DISHWASHER

(75) Inventors: Douglas B. Beaudet, Mattawan, MI (US); Vincent A. Ireland, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 281 days.

(21) Appl. No.: 12/851,628

(22) Filed: Aug. 6, 2010

(65) Prior Publication Data

US 2012/0031432 A1 Feb. 9, 2012

(51) Int. Cl.
*A47L 15/42* (2006.01)
*A47L 15/00* (2006.01)

(52) U.S. Cl.
CPC ..... *A47L 15/0021* (2013.01); *A47L 15/4293* (2013.01); *A47L 2301/04* (2013.01); *A47L 2401/023* (2013.01); *A47L 2401/04* (2013.01); *A47L 2401/20* (2013.01); *A47L 2501/20* (2013.01); *A47L 2501/26* (2013.01); *A47L 2501/30* (2013.01)
USPC ..... 134/57 D; 134/58 D

(58) Field of Classification Search
CPC ..... A47L 15/4293; A47L 15/0018; A47L 15/0047; A47L 2301/00; A47L 2301/04; A47L 2301/06; A47L 2301/08; A47L 15/4248; A47L 2501/20; A47L 15/4289; A47L 15/4221
USPC ..... 134/57 D, 58 D
See application file for complete search history.

(56) References Cited

U.S. PATENT DOCUMENTS

| | | | | |
|---|---|---|---|---|
| 5,131,419 | A | 7/1992 | Roberts | |
| 7,857,908 | B2 * | 12/2010 | Lee | 134/18 |
| 2005/0039777 | A1 * | 2/2005 | Jerg et al. | 134/18 |
| 2006/0037632 | A1 * | 2/2006 | Nito et al. | 134/56 R |
| 2006/0260649 | A1 * | 11/2006 | Lee | 134/18 |
| 2007/0006901 | A1 * | 1/2007 | Cho et al. | 134/25.2 |
| 2007/0068562 | A1 | 3/2007 | Wetzel et al. | |
| 2007/0192731 | A1 * | 8/2007 | Townsend et al. | 715/788 |
| 2007/0272272 | A1 * | 11/2007 | Choi et al. | 134/18 |
| 2008/0077281 | A1 | 3/2008 | Gaus | |
| 2008/0283091 | A1 * | 11/2008 | Steiner et al. | 134/6 |
| 2009/0056754 | A1 * | 3/2009 | Rolek | 134/18 |
| 2009/0178698 | A1 * | 7/2009 | Delgado | 134/57 D |
| 2010/0101611 | A1 * | 4/2010 | Chen et al. | 134/25.2 |

(Continued)

FOREIGN PATENT DOCUMENTS

| | | | |
|---|---|---|---|
| DE | 4214188 | A1 | 11/1993 |
| DE | 10162501 | A1 | 7/2003 |
| DE | 10162505 | A1 | 7/2003 |
| EP | 1128759 | B1 | 9/2001 |

(Continued)

OTHER PUBLICATIONS

German Search Report for Counterpart DE102011050951.8, Jul. 24, 2014.

*Primary Examiner* — Michael Kornakov
*Assistant Examiner* — Katelyn Whatley

(57) ABSTRACT

A method for controlling the operation of an automatic dishwasher including receiving input for a zonal wash cycle from a user interface to a controller indicating a selection of a first cleaning cycle corresponding to a first wash zone and a second cleaning cycle, different from the first cleaning cycle, corresponding to a second wash zone, and implementing a zonal wash cycle by implementing each of the first and second cleaning cycles during a single cycle of operation of the dishwasher to define the zonal wash cycle.

25 Claims, 15 Drawing Sheets

(56) References Cited

U.S. PATENT DOCUMENTS

| | | | | |
|---|---|---|---|---|
| 2010/0139722 | A1 | 6/2010 | Koch et al. | |
| 2010/0192995 | A1 | 8/2010 | Bertsch et al. | |
| 2011/0145999 | A1* | 6/2011 | Motamedi | 8/137 |
| 2011/0181516 | A1* | 7/2011 | Mallory et al. | 345/173 |

FOREIGN PATENT DOCUMENTS

| | | | |
|---|---|---|---|
| EP | 1371319 | B1 | 12/2003 |
| JP | 2009273490 | A | 11/2009 |
| KR | 100748907 | B1 | 5/2006 |
| WO | 2008/090180 | A1 | 7/2008 |

* cited by examiner

METHOD FOR CONTROLLING ZONAL WASHING IN A DISHWASHER

BACKGROUND OF THE INVENTION

Contemporary automatic dishwashers for use in a typical household include a tub and upper and lower racks or baskets for supporting soiled utensils within the tub. A spray system and a filter system are provided for re-circulating wash liquid throughout the tub to remove soils from the dishes. The dishwasher may have a controller that implements a number of pre-programmed cycles of operation to wash dishes contained in the tub.

SUMMARY OF THE INVENTION

The invention relates to a method of controlling the operation of an automatic dishwasher that includes a wash tub defining a wash chamber, a liquid spraying system defining multiple wash zones within the wash chamber, a controller having multiple cleaning cycles and operably coupled with the liquid spraying system to implement any of the multiple cleaning cycles, and a user interface operably coupled with the controller to provide for input by a user. The method includes receiving input for a zonal wash cycle from the user interface to the controller indicating a selection of a first cleaning cycle from the multiple cleaning cycles corresponding to a first wash zone of the multiple wash zones and a second cleaning cycle, different from the first cleaning cycle, from the multiple cleaning cycles corresponding to a second wash zone, different from the first wash zone, of the multiple wash zones and implementing a zonal wash cycle by implementing each of the first and second cleaning cycles for the corresponding one of the first and second wash zones during a single cycle of operation of the dishwasher to define the zonal wash cycle.

DESCRIPTION OF EMBODIMENTS OF THE INVENTION

Figure 1:
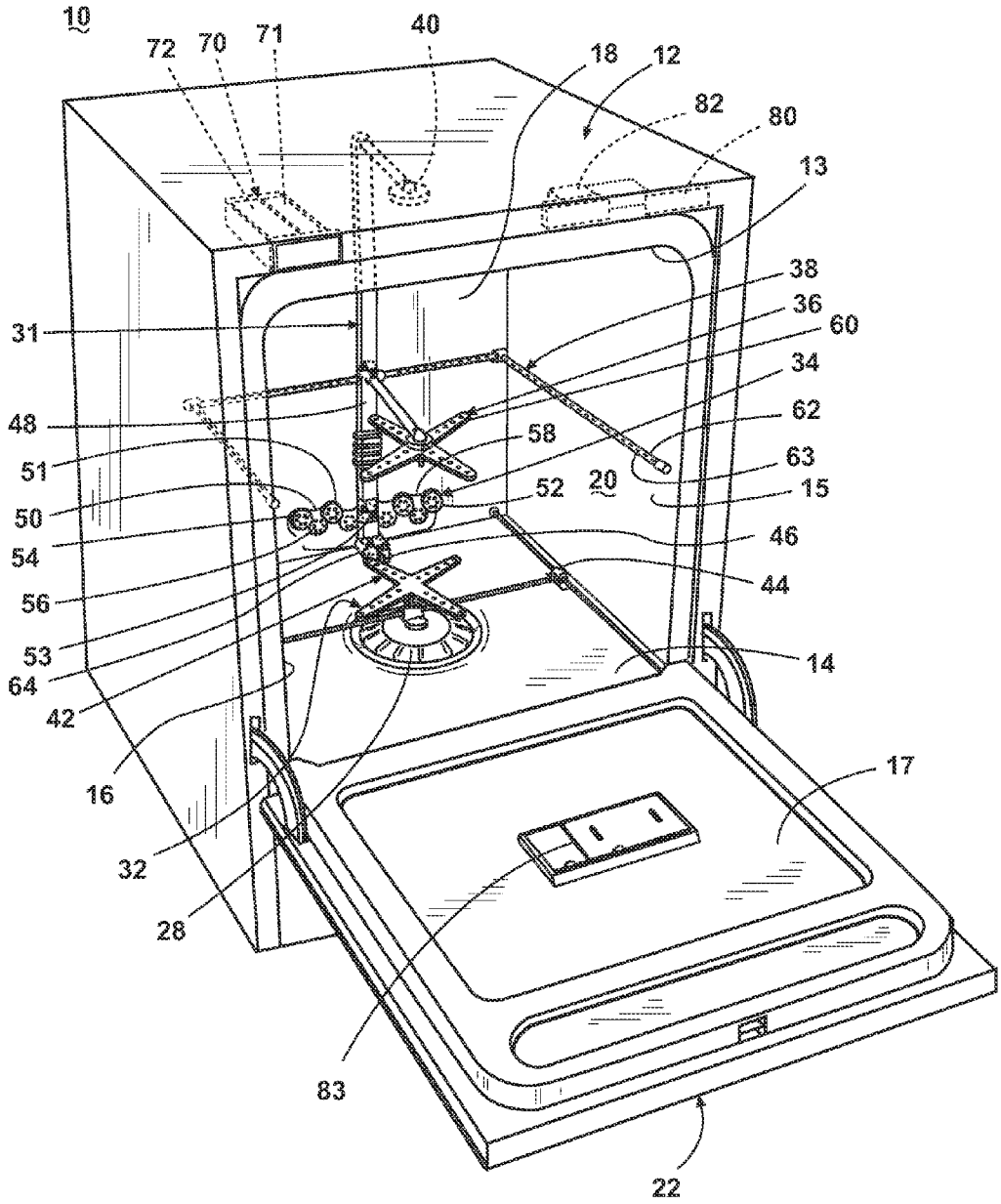
FIG. 1 is a perspective view of a dishwasher having multiple wash zones according to a first embodiment of the invention.
Figure 2:
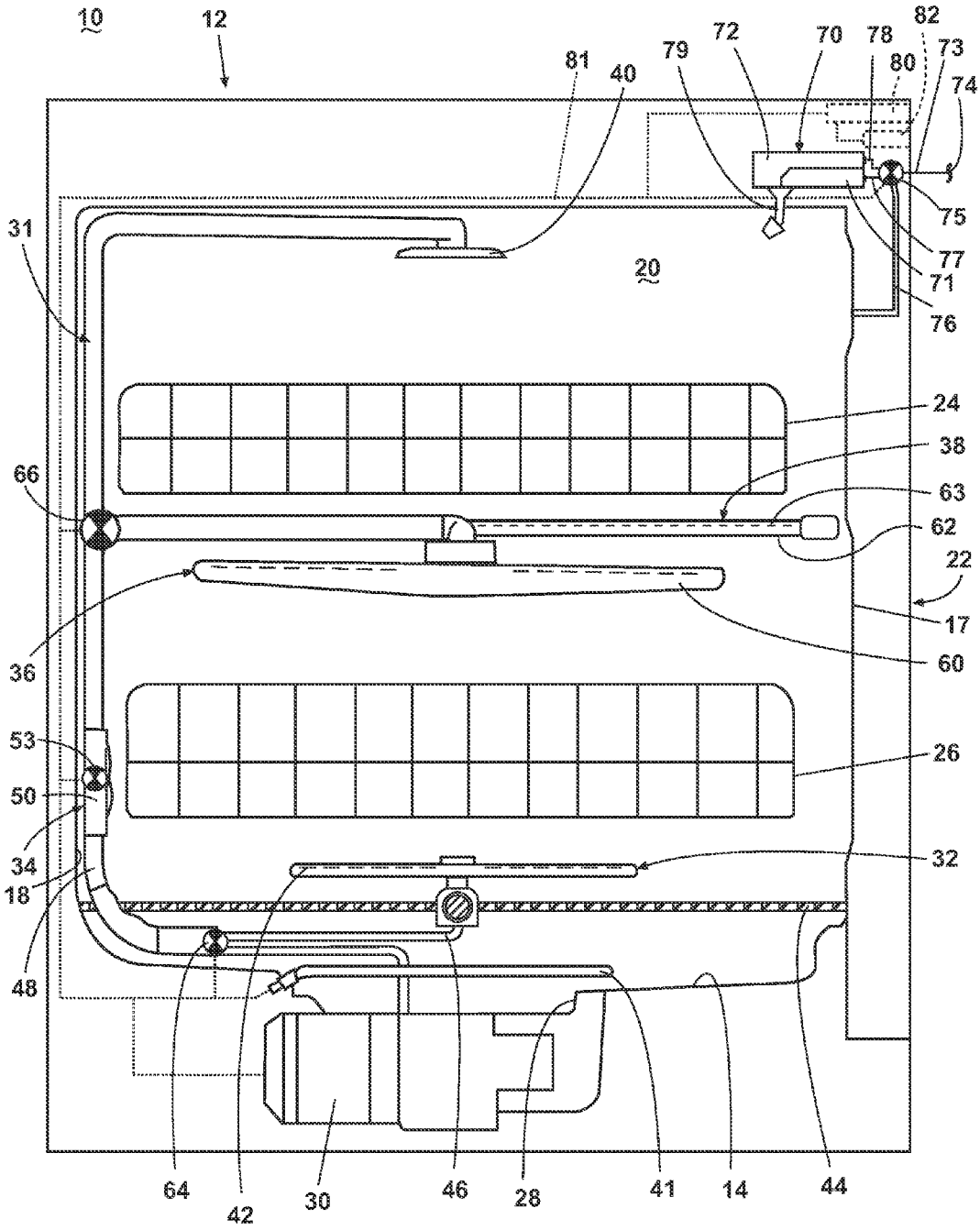
FIG. 2 is a schematic, cross-sectional view of the dishwasher shown in FIG. 1 showing dish racks mounted in a tub of the dishwasher.

Referring to FIGS. 1 and 2, a first embodiment of the invention may be illustrated as a cleaning appliance in the environment of a dishwasher 10. The dishwasher 10 shares many features of a conventional automated dishwasher, which will not be described in detail herein except as necessary for a complete understanding of the invention. The dishwasher 10 includes a housing 12 having a top wall 13, bottom wall 14, two side walls 15, 16, a front wall 17, and a rear wall 18. The walls 13, 14, 15, 16 and 18 collectively define a wash tub defining a space or wash chamber 20 for washing dishes. As one of skill in the art will appreciate, the front wall 17 may be the interior of a door 22, which may be pivotally attached to the dishwasher 10 for providing access to the wash chamber 20 for loading and unloading dishes or other washable items. While the present invention is described in terms of a conventional dishwashing unit, it could also be implemented in other types of dishwashing units such as in-sink dishwashers or drawer dishwashers.

Utensil holders have not been illustrated in FIG. 1 for the sake of clarity; however, FIG. 2 illustrates that the dishwasher 10 includes utensil holders in the form of upper and lower racks 24, 26, which are located within the wash chamber 20 and receive utensils for washing. The upper and lower racks 24, 26 are typically mounted for slidable movement in and out of the wash chamber 20 for ease of loading and unloading. As used in this description, the term utensil may be generic to consumer articles such as dishes and the like that are washed in the dishwasher 10 and expressly includes, dishes, plates, bowls, silverware, glassware, stemware, pots, pans, and the like.

The bottom wall 14 of the dishwasher 10 may be sloped to define a lower tub region or sump 28. A pump assembly 30 may be located in or around a portion of the bottom wall 14 and in fluid communication with the sump 28 to draw wash liquid in from the sump 28 and to pump the liquid to a liquid spraying system 31 defining multiple wash zones within the wash chamber 20. The liquid spraying system 31 as illustrated includes several different spray sources, including a first lower spray assembly 32, a second lower spray assembly 34, a first mid-level spray assembly 36, a second mid-level spray assembly 38, and an upper spray assembly 40, all of which may be selectively operated to define multiple wash zones within the wash chamber 20. A heater 41 may be located within the sump 28 for heating the liquid contained in the sump 28. Heater 41 may also be configured to heat air to dry the utensils in the wash chamber 20.

The first lower spray assembly 32 is illustrated as including a rotatable spray arm 42 supported on a movable sprayer carriage 44. Alternatively, a fixed or non-rotatable sprayer may be supported on the movable sprayer carriage 44 and may be configured to deliver a spray of wash liquid in a generally fixed direction, such as vertically upward, without departing from the scope of the invention. Such a spray assembly is set forth in detail in U.S. patent application Ser. No. 11/845,158, filed Aug. 27, 2007, and titled "Dishwasher with Targeted Sensing," which is incorporated herein by reference in its entirety. The movable sprayer carriage 44 according to U.S. patent application Ser. No. 11/845,158 may be configured for selective bi-directional movement to position the sprayer 42 at a selected location in the wash chamber 20. A motor (not illustrated) or other drive mechanism may be operably coupled with the first lower spray assembly 32 to move the sprayer 42 on the sprayer carriage 44.

The sprayer carriage 44 supports the sprayer 42, which may be fluidly coupled through a flexible liquid delivery line 46 and a supply conduit 48 to the pump assembly 30 such that the sprayer 42 may spray liquid for washing and rinsing utensils within the wash chamber 20. The supply conduit 48 extends generally rearward from the pump assembly 30 to the rear wall 18 and extends upwardly to supply wash liquid to the spray assemblies 32-40. The rotating first lower spray assembly 32 may be configured to rotate in the wash chamber 20 and spray a flow of treating liquid in a generally upward direction, over a portion of the interior of the wash chamber 20. The spray from the rotating lower spray assembly 32 may be typically directed to treat utensils located in the lower rack 26.

The second lower spray assembly 34 is illustrated as being located adjacent the lower rack 26 toward the rear of the wash chamber 20. The second lower spray assembly 34 is illustrated as including a vertically oriented spray manifold 50. The spray manifold 50 may not be limited to this position; rather, the spray manifold 50 could be located in virtually any part of the wash chamber 20. Alternatively, the manifold 50 could be positioned underneath the lower rack 26, adjacent or beneath the first lower spray assembly 32. Such a spray manifold is set forth in detail in U.S. patent application Ser. No. 12/101,302, filed Apr. 11, 2008, and titled "Multiple Wash Zone Dishwasher," which is incorporated herein by reference in its entirety. The spray manifold according to U.S. patent application Ser. No. 12/101,302 may be in fluid communication with the wash liquid supply conduit 48 such that wash liquid may be selectively provided to the manifold 50.

As more easily seen in FIG. 1, the manifold 50 may be configured to have two symmetrical opposing halves 51, 52 positioned on opposite sides of the supply conduit 48 with each half 51, 52 being configured to selectively receive wash liquid being pumped through the supply conduit 48. A valve 53 may be provided to selectively divert wash liquid from the supply conduit 48 to each half 51, 52 of the manifold 50. Each half 51, 52 of the manifold 50 may include a plurality of spray nozzles 54 having apertures 56 configured to spray wash liquid into the lower rack 26. The spray nozzles 54 may be fixed or rotatable with respect to the manifold 50. Additionally, each half 51, 52 of the manifold 50 may be configured with one or more passageways 58 to deliver wash liquid from the supply conduit 48 to the apertures 56. The wash liquid being sprayed from the apertures 56 may be under pressure and may thereby create an intensified spray. The second lower spray assembly 34 may be configured to spray a flow of treating liquid from the apertures 56, in a generally lateral direction, over a portion of the interior of the wash chamber 20. The spray from the apertures 56 may be typically directed to treat utensils located in the lower rack 26.

FIG. 2 illustrates that the first mid-level spray assembly 36 may be fluidly coupled with the supply conduit 48 and positioned between the upper rack 24 and the lower rack 26. The first mid-level spray assembly 36 is illustrated as including a spray arm 60 fluidly coupled with the supply conduit 48 and that may be configured to rotate in the dishwasher 10 and spray a flow of wash liquid in a generally upward direction, over a portion of the interior of the wash chamber 20. In this case, the spray from the first mid-level spray assembly 36 may be directed to utensils in the upper rack 24. The first mid-level spray assembly 36 may optionally also provide a liquid spray downwardly onto the lower rack 26, but for purposes of simplification, this will not be illustrated or described herein.

The second mid-level spray assembly 38 is illustrated as one or more spray tubes 62 fluidly coupled with the supply conduit 48 and positioned between the upper rack 24 and the lower rack 26. The second mid-level spray assembly 38 may be mounted on the underside of the upper rack 24, in which case the spray tubes 62 may move into and out of the front of the dishwasher 10 with the upper rack 24. Alternatively the second mid-level spray assembly 38 may be mounted to any of the walls 15, 16 and 18 that define the wash chamber 20.

The spray tubes 62 may be selectively rotatable and may include a plurality of spray outlets 63 spaced along the spray tubes 62. The spray tubes 62 may be operably coupled with a drive mechanism (not shown) to selectively position the plurality of spray outlets 63. Alternatively, the plurality of spray outlets 63 may be directed generally tangentially in the same direction for causing rotation of the spray tube 62. Thus, the second mid-level spray assembly 38 may be configured to spray a flow of treating liquid from the plurality of spray outlets 63, in a downward, upward, and lateral direction, over a portion of the interior of the wash chamber 20. The spray from second mid-level spray assembly 38 may be directed to treat utensils located in both the upper rack 24 and the lower rack 26. The spray tubes 62 may provide wash liquid to the sides of the upper rack 24 and the lower rack 26 that the other spray assemblies may not reach.

The upper spray assembly 40 is illustrated as being a fixed spray head positioned above the upper rack 24 which may be fluidly coupled with the supply conduit 48. Typically, the upper spray assembly 40 generally directs a spray of wash water in a generally downward direction and helps wash dishes on both the upper and lower racks 24, 26.

Wash liquid may be simultaneously supplied to the spray assemblies 32-40 during operation of the dishwasher 10 so that liquid may be sprayed concurrently by all the spray assemblies 32-40. However, the liquid recirculation system 31 may also include a number of valves including valve 53, valve 64, and valve 66 to selectively control the fluid flow to the spray assemblies 32-40 during operation of the dishwasher 10. As previously described, valve 53 may be provided to selectively divert wash liquid from the supply conduit 48 to the second lower spray assembly 34. Valve 64 may be included to selectively supply wash liquid from the supply conduit 48 to the first lower spray assembly 32. Further, valve 66 may be positioned in the supply conduit 48 and may be operated to selectively control liquid being delivered to the first mid-level spray assembly 36, the second mid-level spray assembly 38, and the upper spray assembly 40. The valves 53, 64, and 66 may be operably coupled with a controller 80 and many different control schemes for the valves 53, 64, and 66 may be provided in response to the cycle and options selected by the user through a user interface 82.

For example, the valve 66 may be controlled to direct all liquid from the supply conduit 48 to the first mid-level spray assembly 36, to the second mid-level spray assembly 38, or to the upper spray assembly 40. The valve 66 may also be controlled to direct a portion of the liquid to each of the first mid-level spray assembly 36, the second mid-level spray assembly 38, and the upper spray assembly 40 to thereby simultaneously spray liquid from each. The valve 66 may also be adjustable to control the amount or ratio of liquid delivered to first mid-level spray assembly 36, the second mid-level spray assembly 38, and the upper spray assembly 40. In this manner, the valve 66 may also be controlled to direct a portion of the liquid to any combination of the spray assemblies 36-40. For example, the valve 66 may be controlled so that spray of liquid from the upper spray assembly 40 may be continuously emitted while the spray of liquid from the first mid-level spray assembly 36, the second mid-level spray assembly 38 are selectively emitted.

Thus, the liquid spraying system 31 may create a zonal wash cycle by spraying liquid within the wash chamber 20 from the various spray assemblies 32-40. More specifically, the pump assembly 30 draws liquid from the sump 28 and delivers it to one or more of the spray assemblies 32-40 through the supply conduit 48, where the liquid may be sprayed back into the wash chamber 20 through the spray assemblies 32-40 and drains back to the sump 28 where the process may be repeated.

The spray assemblies 32-40 depicted and described herein are for illustrative purposes only, and are not meant to limit the disclosure in any way. It has been contemplated that the spray assemblies 32-40 may be of any structure and configuration. For example, the dishwasher 10 may include other sprayer configurations such as a sprayer assembly movable in a generally vertical plane, a translating wash arm, a discrete nozzle-type sprayer, or an array of wall-mounted nozzle-type sprayers. These may all be individually controllable, or controllable in selected groups, to deliver a spray of wash liquid to selected areas of the wash chamber.

A dispensing system 70 may be provided for dispensing treating chemistries, including water, into the wash chamber 20. The dispensing system 70 may be located anywhere within the dishwasher 10 as long as it is positioned to be able to dispense the treating chemistry into the wash chamber 20. The type of dispensing system 70 is not germane to the invention. It may be a single dose dispensing system, a multiple dose dispensing system (i.e., a bulk dispenser), or a combination of both. The dosage may be constant, variable, user-controlled, or automatically controlled. Different types of treating chemistries may be dispensed from the dispensing system 70, e.g. water, detergents, bleach, enzymes, anti-spotting agents, aroma agents, etc. Some of these treating chemistries are deleterious to another chemistry's efficacy. An example may be bleach, which is known to destroy certain enzymes found in detergents. As illustrated, the dispensing system 70 may contain multiple cups 71, 72 which may contain different types of treating chemistry to be dispensed to the wash chamber 20 during a wash cycle of the dishwasher 10.

The treating chemistry dispensed from the dispensing system 70 may be mixed with water and applied to the utensils in the wash chamber 20. As illustrated the dishwasher 10 may further include a conduit 73 coupled with a water supply 74 to fluidly couple the dishwasher 10 to the water supply 74. A valve 75 couples the conduit 73 and water supply 74 with the wash chamber 20 through a supply line 76. The valve 75 also couples the conduit 73 and water supply 74 with the dispensing system 70 through supply lines 77 and 78. Supply lines 77 and 78 lead to cups 71 and 72, respectively, so that treating chemistry in the cups 71 and 72 may be mixed with water from the conduit 73 and dispensed into the wash chamber 20 through a dispensing line 79. Thus, the valve 75 may be used to control the introduction of fresh water from the water supply 74 into the wash chamber 20, or the dispensing system 70. The dispensing line 79 fluidly couples the dispensing system 70 with the wash chamber 20. Thus, fresh water may be delivered from the water supply 74 through the conduit 73, valve 75 and one of two supply lines 77 and 78 into the dispensing system 70 for flushing treating chemistry from one of two cups 71 and 72 through the dispensing line 79 into the wash chamber 20. The valve 75 may be electrically coupled with the controller 80 through a valve control lead 81. The controller 80 may control the operation of the valve 75 in response to the cycle and options selected by the user through the user interface 82.

As illustrated, the dispensing system 70 may be fixed within the housing 12 and have a moveable door, hatch, access panel, or other access mechanism (not shown) for access to the dispensing system 70. It has also been contemplated that the dispensing system 70, or a component of the dispensing system 70, may alternatively be carried by the door 22. For example, a separate rinse aid dispenser 83 may be located in the door 22 or virtually anywhere within the dishwasher 10. It will be understood that depending on the type of dishwasher and the type of detergent used, the dispensing system 70 and the rinse aid dispenser 83 may be incorporated into one dispensing mechanism.

The liquid spraying system 31 and the dispensing system 70 may differ from the configuration shown in FIGS. 1 and 2, such as by inclusion of other valves, conduits, spray assemblies, treating chemistry dispensers, and the like, to control the flow of liquid through the dishwasher 10 and for the introduction of more than one type of treating chemistry. The dishwasher 10 may further include other conventional components, such as a filter or a steam generator; however, these components are not germane to the present invention and will not be described further herein.

Figure 3:
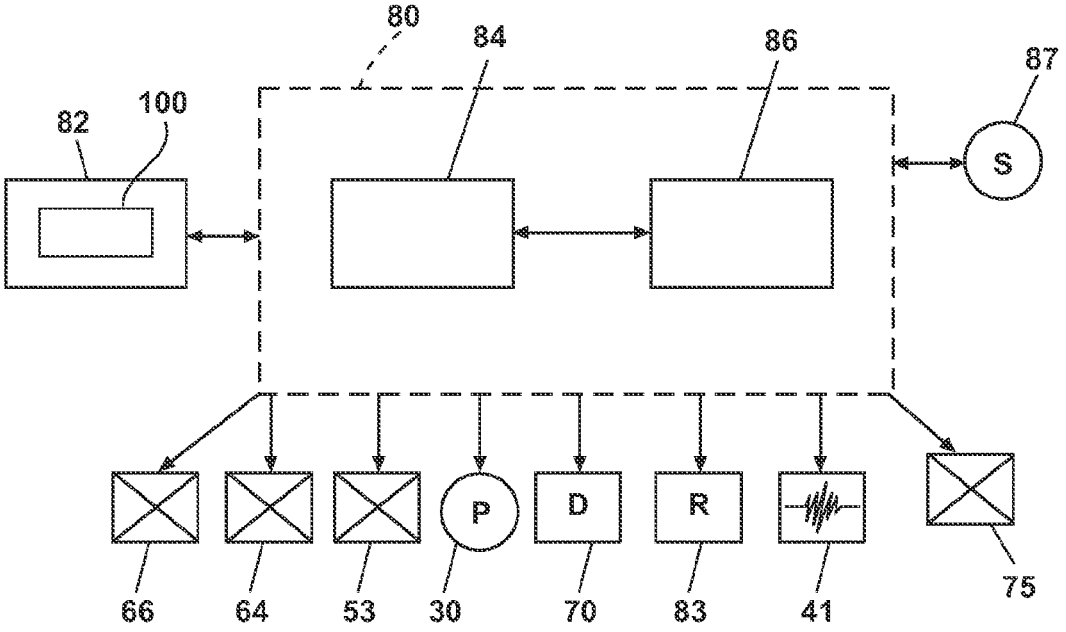
FIG. 3 is a schematic view of a control system of the dishwasher of FIG. 1.

As illustrated in FIG. 3, the controller 80 may be provided with a memory 84 and a central processing unit (CPU) 86. The memory 84 may be used for storing control software that may be executed by the CPU 86 in completing a cycle of operation using the dishwasher 10 and any additional software. For example, the memory 84 may store one or more pre-programmed cycles of operation that may be selected by a user and completed by the dishwasher 10. Non-limiting examples of cleaning cycles include normal, light/china, heavy/pots and pans, and rinse only. The memory 84 may also be used to store information, such as a database or table, and to store data received from one or more components of the dishwasher 10 that may be communicably coupled with the controller 80.

The controller 80 may also receive input from one or more sensors 87, which are known in the art and not shown for simplicity. Non-limiting examples of sensors 87 that may be communicably coupled with the controller 80 include a turbidity sensor to determine the soil load associated with a selected grouping of utensils, such as the utensils associated with a particular area of the wash chamber and a sensor for determining a load value at selected locations within the dishwasher 10. The load value may be reflective of either or both a utensil load, i.e. the number and/or size of the utensils in the dishwasher, and/or a soil load, i.e. the quantity of soil on the utensils.

The controller 80 may be operably coupled with one or more components of the dishwasher 10 for communicating with and controlling the operation of the components to complete a cycle of operation. For example, the controller 80 may be coupled with heater 41 for heating the wash liquid during a cycle of operation, components of the liquid spraying system 31 including the pump assembly 30, and valves 53, 64, and 66 for supplying washing liquid to the spray assemblies 32-40, the dispensing system 70, the rinse aid dispenser 83, and valve 75 for dispensing treating chemistry and water to the wash chamber 20 during a cycle of operation. The controller 80 may also be coupled with the user interface 82 for receiving user-selected inputs and communicating information to the user.

The controller 80 may control the components of the dishwasher 10 to complete a cycle of operation stored in the controller memory 84 based on a setting of one or more operating parameters. The operating parameters may correspond, for example, to a type of utensil, a soil level, or an amount of utensils in the load. The operating parameters may be set to control the components of the dishwasher 10 to provide the recommended utensil care for the selected cycle of operation. The operating parameters may be set automatically by the controller 80 when the user selects one of the pre-programmed cycles of operation stored in the controller memory 84. Alternatively, one or more of the operating parameters may be set by the user via the user interface 82 to modify one of the pre-programmed cycles of operation according to the user's preferences. For example, the user may select a zone within the wash chamber and then manually set a cleaning cycle for that zone, which may be different than the default wash cycle for the rest of the dishwasher.

The user interface 82 may be provided on the dishwasher 10 and operably coupled with the controller 80. The user interface 82 may be provided on the front of the housing 12 as illustrated in FIG. 1, or on the outer panel of the door 22, and may include operational controls such as dials, lights, switches, and displays enabling a user to input commands to the controller 80 and receive information about the selected cleaning cycle and operating parameters.

To facilitate such selections, the user interface 82 may include a touch-sensitive display or touch screen 100 for receiving input from a user and displaying output to the user. The controller 80 may receive input from the user through the touch screen 100 and display visual outputs to the user in the form of graphics, texts, icons, video and any combination thereof. The touch screen 100 may receive input from the user based on tactile contact, such as by a user touching the touch screen 100 with an object, such as a finger. The controller 80 may detect contact, including movement of the contact, on the touch screen 100 and convert the detected contact into interaction with the objects (graphics, texts, icons, etc. . . . ) displayed on the touch screen 100. The controller 80 may be programmed to detect contact and movement of a contact according to any known methodology.

The touch screen 100 may be any suitable type of touch screen display, such as a liquid crystal display (LCD) or light emitting polymer display (LPD). Non-limiting examples of suitable touch sensing technologies that may be used with the touch screen 100 include capacitive, resistive, infrared, pressure, and surface acoustic waves.

The controller 80 may be provided with software in the controller memory 84 which may be executed by the CPU 86 to sequentially display on the touch screen 100 and navigate through a variety of input/output screens based on the user input received from the touch screen 100. Each input/output screen may provide the user with the opportunity to input information to control the operation of the dishwasher 10 and may provide output to communicate information with the user.

While the invention may be described in the context of a touch screen 100 through which the user may directly interact with the selection screen 110, it is also within the scope of the invention for the user to interact with the selection screen 110 indirectly using any other suitable type of input mechanism, non-limiting examples of which include a mouse, a track ball, a joystick, a dial and one or more buttons or keys.

Figure 4:
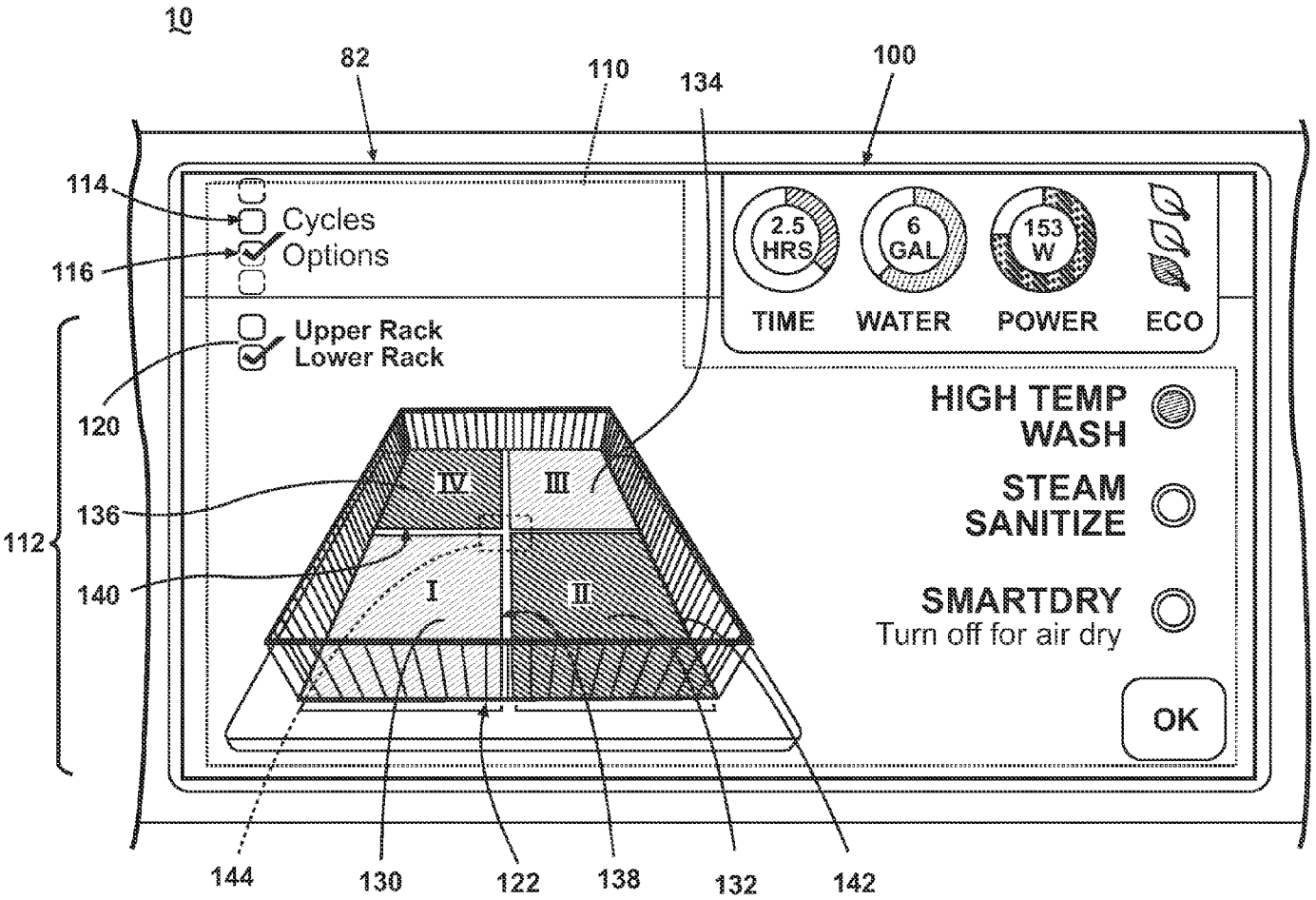
FIG. 4 is a front view of a user interface of the dishwasher of FIG. 1 displaying a rack landscape.

FIG. 4 is a front view of the user interface 82 of the dishwasher 10 of FIG. 1 and illustrates that the touch screen 100 may include, among other things, a selection screen 110 that includes a zonal selector 112, a cycle selector 114, and an options selector 116. The zonal selector 112 may include a dish rack selector 120 corresponding to the upper rack 24 and the lower rack 26 such that a user may select one of the upper rack 24 or the lower rack 26 using the dish rack selector 120. The zonal selector 112 may also include a rack landscape 122 that acts to depict the rack selected by the dish rack selector 120. More specifically, once the user has selected either the upper rack 24 or the lower rack 26 using the dish rack selector 120, the rack landscape 122 for the selected rack may appear on the touch screen 100.

Initially, the rack landscape 122 may be sub-divided into four wash zones 130, 132, 134, and 136 corresponding to four quadrants within the corresponding rack. Each of the multiple wash zones 130, 132, 134, and 136 may be uniquely identified on the user interface, such as by a distinct color, pattern, or number. The four zones 130, 132, 134, and 136 may be sub-divided by the intersection of a vertical boundary line 138 and a horizontal boundary line 140 extending between parallel segments of a landscape border 142. The landscape border 142 may define a square corresponding to the area of the corresponding rack 24 or 26. It may also be within the scope of the invention for the rack landscape 122 to initially be sub-divided into any number of wash zones corresponding to any number of zones within the corresponding rack 24 or 26.

The zonal selector 112 may also include a boundary adjuster 144, which may be selectively moved by the user over the rack landscape 122 to increase or decrease the size of any of the multiple wash zones 130, 132, 134, and 136. The boundary adjuster 144 may be associated with the vertical boundary line 138 and the horizontal boundary line 140 such that movement of the boundary adjuster 144 results in a corresponding movement of the vertical boundary line 138 and/or the horizontal boundary line 140. The boundary adjuster 144 may be an indicator, such as an icon, that a user may drag to adjust the size of the multiple wash zones 130, 132, 134, and 136. Alternatively, it may also be within the scope of the invention for the intersection of the vertical and horizontal boundary lines 138, 140 to form the boundary adjuster 144, such that the intersection may not be highlighted by an indicator. It may also be within the scope of the invention for the intersection of the vertical and horizontal boundary lines 138, 140 to be highlighted in any suitable manner, such as by displaying the intersection in a different color, a higher intensity and/or a flashing indicator to indicate to the user where to contact the screen to adjust the multiple wash zones 130, 132, 134, and 136. Alternatively, the intersection may not be highlighted at all.

Figure 5:
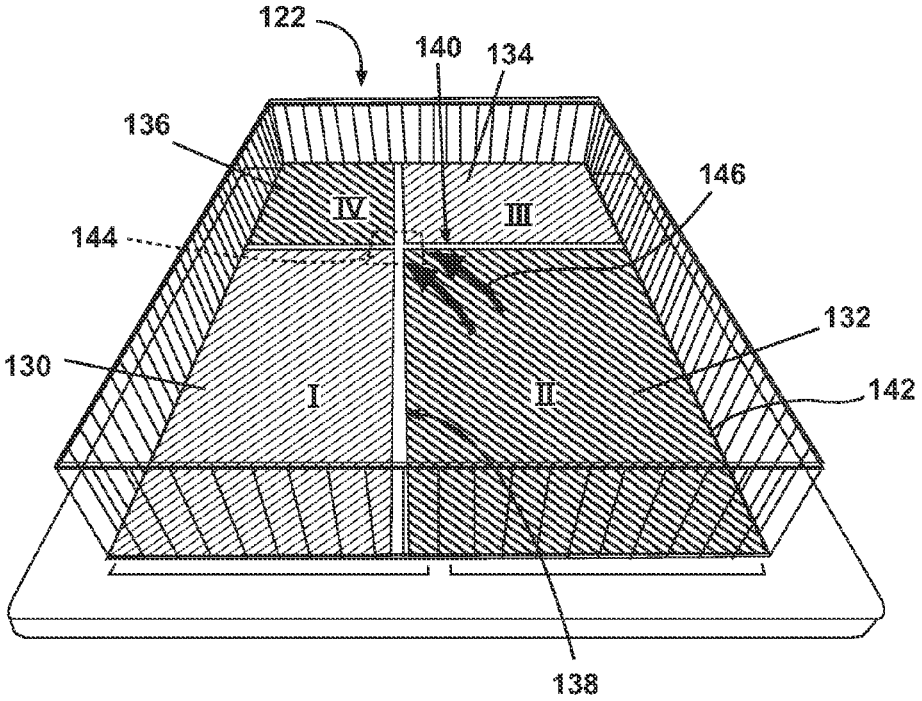
FIGS. 5 and 6 are front views of the rack landscape of the user interface from FIG. 4, illustrating the adjustment of zones within the rack landscape.

As illustrated in FIG. 4, the boundary adjuster 144 may initially be located at the center of the rack landscape 122 such that the vertical boundary line 138 and horizontal boundary line 140 divide the rack landscape 122 into equal-sized zones 130, 132, 134, and 136. As illustrated in FIG. 5, the user may move the boundary adjuster 144 relative to the rack landscape 122 by contacting the touch screen 100 at an area corresponding to or adjacent to the boundary adjuster 144 and moving the contact relative to the rack landscape 122 to a desired location as indicated by the arrows 146.

Figure 6:
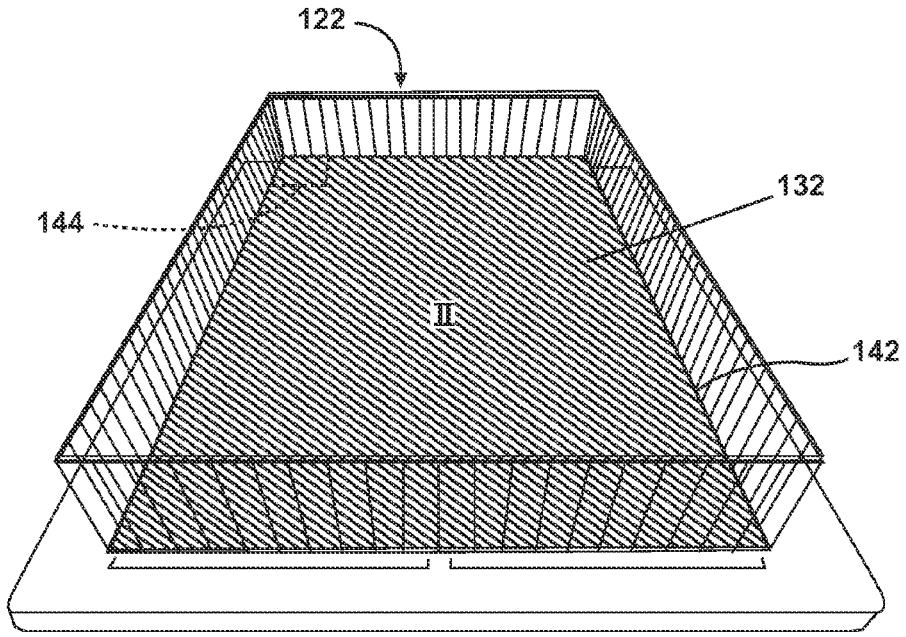

More specifically, the user may contact the touch screen 100 using a finger at an area of the touch screen 100 corresponding to the display of the boundary adjuster 144. The controller 80 may be programmed to detect a contact event within or adjacent to the boundary adjuster 144. Once the contact event has been detected, movement of the contact results in a corresponding movement of the boundary adjuster 144, as is known in the art. In this manner, the user may move the boundary adjuster 144 to a desired location relative to the rack landscape 122. The controller 80 may also be programmed to move the vertical boundary line 138 and horizontal boundary line 140 relative to the rack landscape 122 based on the movement of the boundary adjuster 144. It is within the scope of the invention for the user to adjust the areas of the zones 130, 132, 134, and 136 to be any size. For example the user may even adjust the areas of the zones such that one of the zones may be given all of the area within the landscape border 142 and no area may be given to the other three zones. For example, referring now to FIG. 6, the user may continue to drag the boundary adjuster 144 in the direction indicated by the arrows 146 in FIG. 5 such that the selection zone 132 encompasses the entire area of the rack landscape 122.

Figure 7:
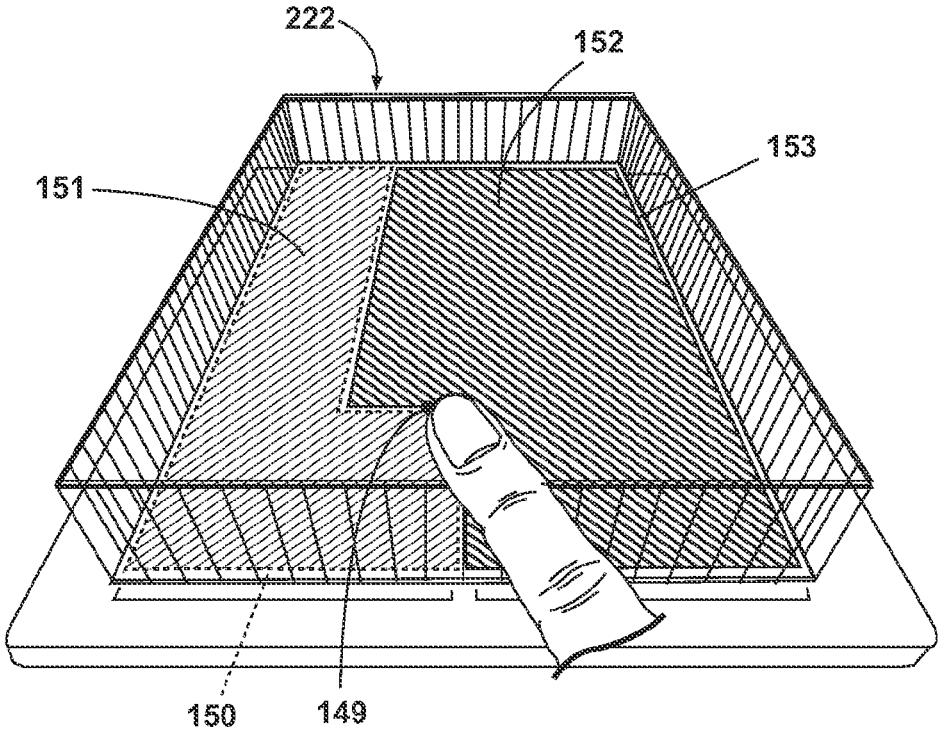
FIG. 7 is a front view of a rack landscape displayed on a user interface according to a second embodiment of the invention, illustrating the creation of zones within the rack landscape.
Figure 8:
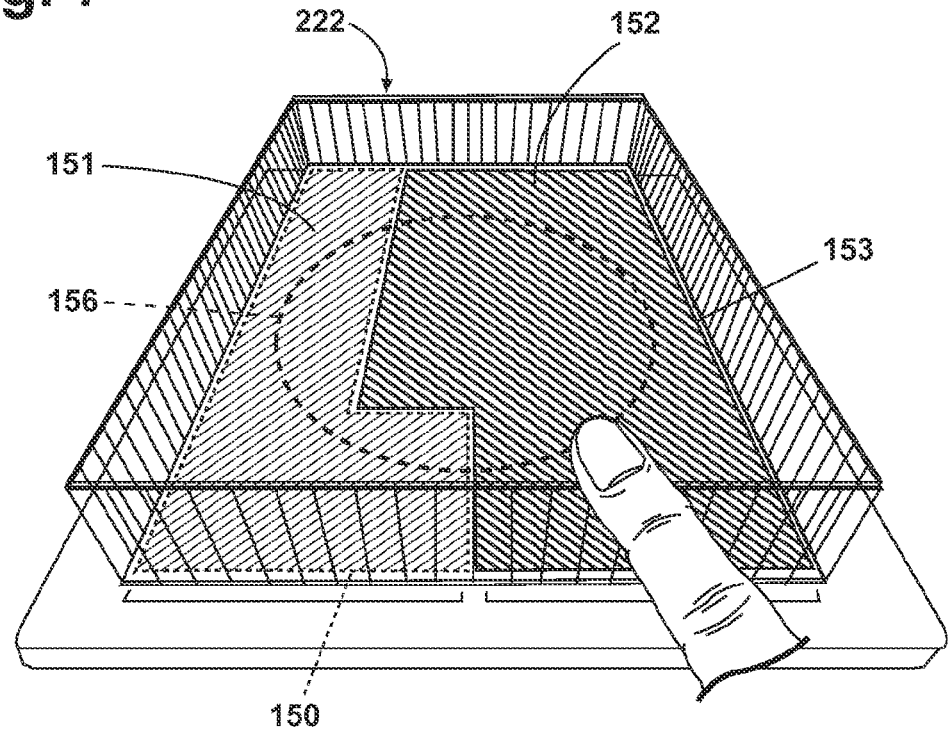
FIGS. 8 and 9 are front views of the rack landscape from FIG. 7, illustrating the creation of new zones within the rack landscape.
Figure 9:
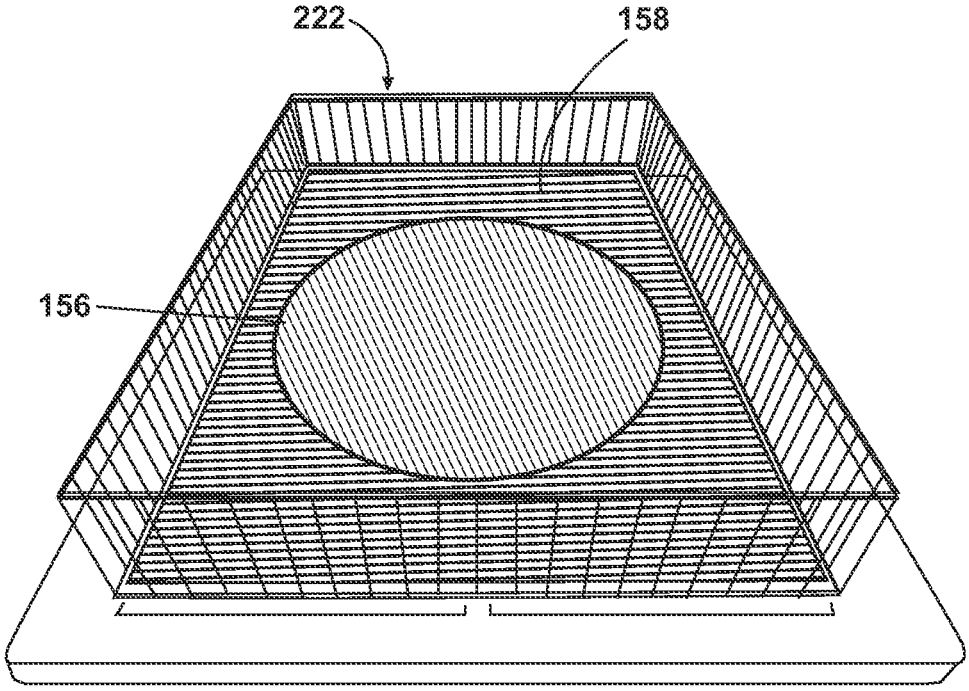

FIGS. 7-9 illustrate a second embodiment of the invention comprising a rack landscape 222 which may be provided on the touch screen 100 of FIG. 4 and which is similar to the first rack landscape 122 except for the manner in which the area of the wash zones are selected and changed. More specifically, rack landscape 222 does not include the vertical boundary line 138 and horizontal boundary line 140. Therefore, elements in the rack landscape 222 similar to those of rack landscape 122 will be numbered with the prefix 200, with it being understood that the description of the like parts of the first embodiment applies to the second embodiment, unless otherwise noted.

With reference to FIG. 7, initially, when a user chooses one of the upper and lower racks 24, 26 using the dish rack selector 120 and the touch screen 100 navigates to the corresponding rack landscape 222, no zones may be shown on the rack landscape 222. A user may create a zone by forming a boundary line on the rack landscape 222. The user may create a zone on the rack landscape 222 by contacting the touch screen 100 at an area corresponding to or adjacent to the rack landscape 222 and moving the contact relative to the rack landscape 222 such that a zone may be formed in a desired location on the rack landscape 222.

For example, the user may contact the touch screen 100 using a finger at an area of the touch screen 100 corresponding to the display of the rack landscape 222 as indicated by numeral 149. The controller 80 may be programmed to detect a contact event within or adjacent to the rack landscape 222. Once the contact event has been detected, movement of the contact as indicated by the dashed lines results in a corresponding zone 151 being formed. In this manner, the user may move the contact on the touch screen 100 to form a boundary line 150 around a desired location relative to the rack landscape 222. In this manner an irregular shaped zone 151 may be formed by the user. The user may create additional zones in a similar manner. Alternatively, as illustrated in FIG. 7, the controller 80 may also be programmed to insert a separate zone 152, which has a boundary line 153, in the remainder of the unselected rack landscape 222.

Each of the multiple wash zones may be uniquely identified on the user interface, such as by a distinct color, pattern, or number. It is within the scope of the invention for any suitable icon and or indicator to be displayed on the touch screen 100 to indicate to a user that the zones are distinct and may be moveable. To change the areas of the previously selected zones a user need only contact the boundary line of a zone and drag it to the desired location. Alternatively, it has been contemplated that the user may draw an entirely new zone on the rack landscape 222 that overlies at least a portion of the previous selected zone. The new zone will supersede the previous zone or zones. For example, FIG. 8 illustrates a new zone 156 being drawn over the zones 151 and 152. FIG. 9 illustrates the newly created zone 156 and a zone 158 that the controller 80 may be programmed to insert relative to the remainder of the unselected rack landscape 222.

Figure 10:
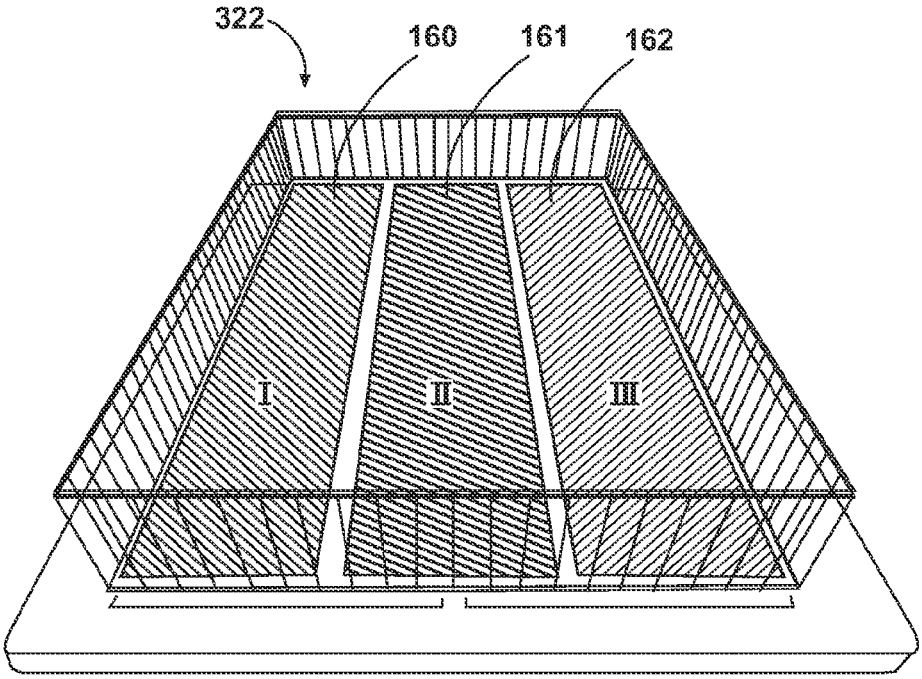
FIG. 10 is a front view of a rack landscape displayed on a user interface according to a third embodiment of the invention.
Figure 11:
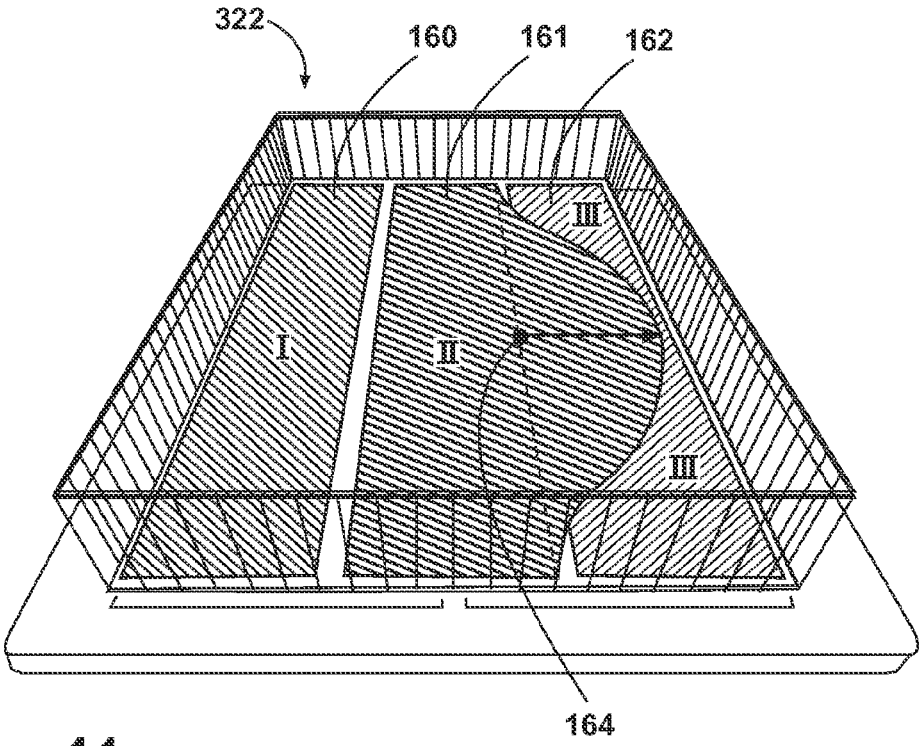
FIGS. 11 and 12 are front views of the rack landscape from FIG. 10, illustrating the adjustment of zones or creation of new zones within the rack landscape.
Figure 12:
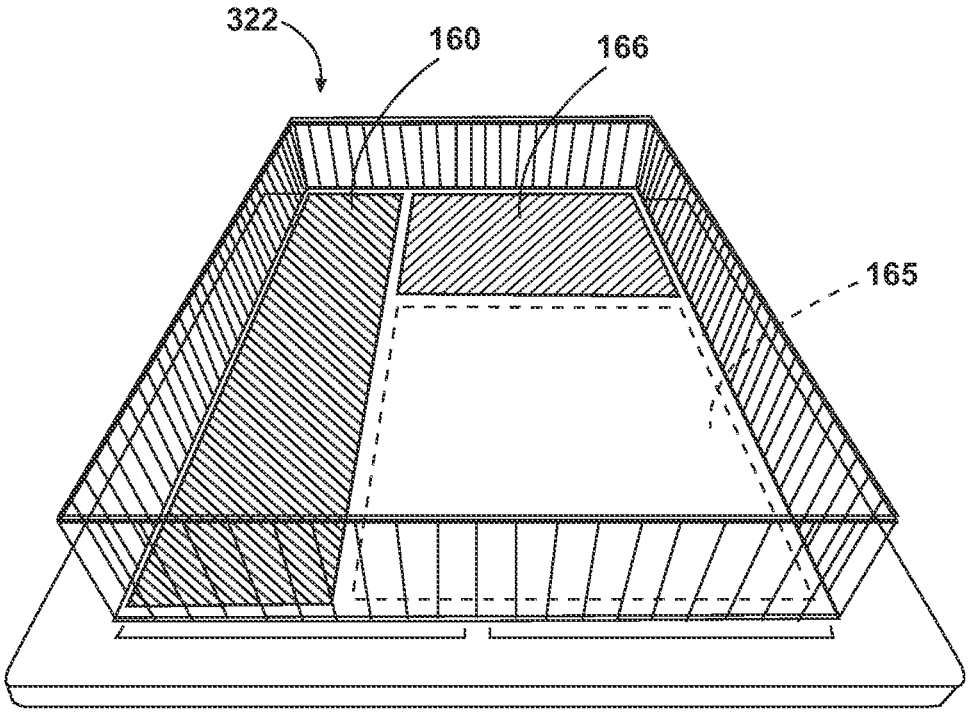

FIGS. 10-12 illustrate a third embodiment of the invention comprising a rack landscape 322 which may be provided on the touch screen 100 of FIG. 4 and which is similar to the second rack landscape 222 except for the manner in which the area of the wash zones are initially illustrated. Therefore, elements in the rack landscape 322 similar to those of rack landscape 222 will be numbered with the prefix 300, with it being understood that the description of the like parts of the first embodiment applies to the second embodiment, unless otherwise noted.

It has been contemplated that when a user chooses one of the upper and lower racks 24, 26 using the dish rack selector 120 and the touch screen 100 navigates to the corresponding rack landscape 322, the rack landscape 322 may have any number of predefined zones that initially appear after the user has selected either the upper rack 24 or the lower rack 26 using the dish rack selector 120. The third embodiment shown in FIG. 10 includes three such predefined zones 160, 161, and 162. Each of the multiple wash zones 160-162 may be uniquely identified on the user interface 82 such as by a distinct color, pattern, or number. It is within the scope of the invention for any suitable icon and or indicator to be displayed on the touch screen 100 to indicate to a user that the zones 160-162 are distinct and may be moveable.

To change the areas of these predefined zones a user need only contact the boundary line of one of the zones and drag it to the desired location. FIG. 11 illustrates that a user may contact the boundary line surrounding zone 161 and drag it relative to the rack landscape 322 such that a new boundary line may be formed in a desired location on the rack landscape 322. For example, the user may contact the touch screen 100 using a finger at an area of the touch screen 100 corresponding to the display of the rack landscape 322 as indicated by numeral 164. The controller 80 may be programmed to detect a contact event within or adjacent to the rack landscape 322. Once the contact event has been detected, movement of the contact as indicated by the arrow results in a corresponding change in the boundary line and the area of zone 161. In this manner an irregular shaped zone may be formed by the user. The controller 80 may be programmed to shift the area of the zone 162 relative to the changes made by the user to zone 161. Alternatively, the controller 80 may simply delete the zone 161 as a portion of it has been superseded by the user's actions.

Additionally, it has been contemplated that to change an area of a predefined zone the user may draw an entirely new zone on the rack landscape 322 that overlies at least a portion of the predefined zone. In such a case, the new zone supersedes the predefined zone. For example, FIG. 12 illustrates a new zone 165 that has been drawn over the predefined zones 161 and 162 in FIG. 10. Also illustrated is a zone 166 that the controller 80 may be programmed to insert relative to the remainder of the unselected rack landscape 322.

With reference to FIG. 4, once zones are defined using the zonal selector 112, cycles may be selected for each defined zone using the cycle selector 114 and the options selector 116. In this manner, a user may define a zone in one of the upper and lower racks 24 and 26 and then select a cleaning cycle appropriate for dishes located in that zone. More specifically, once the zones are defined using the zonal selector 112 a user may select the zone. The zone may be selected by the user contacting the touch screen 100 at an area corresponding to or adjacent to the desired zone. When selected the zone within the rack landscape 122 or an indicator (not shown) corresponding to the selected zone may illuminate or otherwise communicate to the user the selected zone. Conversely, when the finger deselects a zone, by selecting another zone, the deselected zone within the rack landscape 122 or the indicator corresponding to the deselected zone de-illuminates or otherwise communicates to the user that the corresponding zone is not selected. Alternatively, once the wash zones are defined numeral indicators may be assigned to each zone. Such numbers may be listed on the touch screen 100 and the user may select the number on the touch screen 100 to select the desired wash zone.

Once a user selects a first zone, an input/output screen, which may be part of the cycle selector 114, may be presented to the user, prompting the user to select a desired cleaning cycle from a plurality of available user-selectable cycles for the selected zone. Exemplary cycles include Smart Wash, Pots/Pans, Normal Wash, China Gentle, Fast Wash, and Quick Rinse. During the Smart Wash mode, the cleaning level and cycle time may be automatically selected based on a size of the dish load and a soil level of the dish load. The Pots/Pans mode may be utilized for hard-to-clean and heavily soiled pots, pans, and other dishes, the Normal Wash mode may be employed for dish loads with a normal amount of food soil, and the China Gentle mode may be suited for lightly soiled items or china and crystal. The Fast Wash mode quickly washes dish loads that are pre-rinsed, and the Quick Rinse mode rinses dish loads that will not be washed immediately.

The user may continue selecting wash zones and corresponding cycles to be implemented within those wash zones until each wash zone has a corresponding cleaning cycle. If no cleaning cycles are selected for a wash zone the user may be prompted to select a cleaning cycle for that zone. In this manner a user may indicate that the various wash zones are to be used. Conversely, the user may indicate that a defined wash zone is not to be used by not selecting a corresponding cleaning cycle for that wash zone. A zonal wash cycle may be implemented wherein a zone does not have an associated cleaning cycle, in that case no cleaning cycle will be implemented for that wash zone.

Based on the zone or cycle selected by the user, additional input/output screens may be displayed in which the user may modify the selected cycle by adjusting one or more operating parameters or by providing input upon which the controller 80 may automatically modify the selected cleaning cycle. Each subsequent input/output screen displayed to the user on the touch screen 100 may be based on user input from the previously displayed input/output screen. Alternatively, once any number of cleaning cycles have been selected for the corresponding zones, the user may desire to modify or tailor all of these cleaning cycles according to the user's preferences. Exemplary options include Hi-Temp, Steam Sanitize, and Smart Dry. The Hi-Temp option increases the water temperature during wash portions of the cycle, the Steam Sanitize option raises the water temperature in a final rinse portion of the cycle, and the Smart Dry option dries the dish load with heat. Thus, for example, if the user desires to wash all of the utensils at a higher temperature, the user may select the Hi-Temp wash option for all of the wash zones.

It is within the scope of the invention for the touch screen 100 to have any shape and to display output other than the selection screen 110 that may or may not be related to the selection screen 110, such as icons or text to navigate away from the selection screen, to start a cycle of operation, to adjust other parameters of the operating cycle, to select an operating cycle, and a help button. Moreover, the user interface 82 may also include a status indicator that may communicate to the user during the implementation of the zonal wash cycle to provide an operating status of the zonal wash cycle. For example, the mode status indicator may include visual indicators to inform the user when the zonal wash cycle may be at a washing stage or a drying stage, or when the dish load may be clean upon completion of the selected zonal wash cycle. Additionally, the status indicator may communicate to the user when the dish load may be sanitized after completion of the selected zonal wash cycle with the Sani-Rinse option.

The status indicator may also illustrate to the user the zonal wash cycle that has thus far been selected. Such an illustration of the zonal wash cycle may be done prior to the implementation of the zonal wash cycle to form a preview of the zonal wash cycle. Such a preview of the zonal wash cycle may illustrate any conflicts in the zonal wash cycle. One example of a conflict that may occur includes if a Pots/Pans cycle, which emits a heavy wash is selected for one zone next to another zone with a china cycle, which requires a more gentle wash. The user may be alerted to such a conflict in case they wish to change the arrangement of the utensils within the dishwasher 10.

Figure 13:
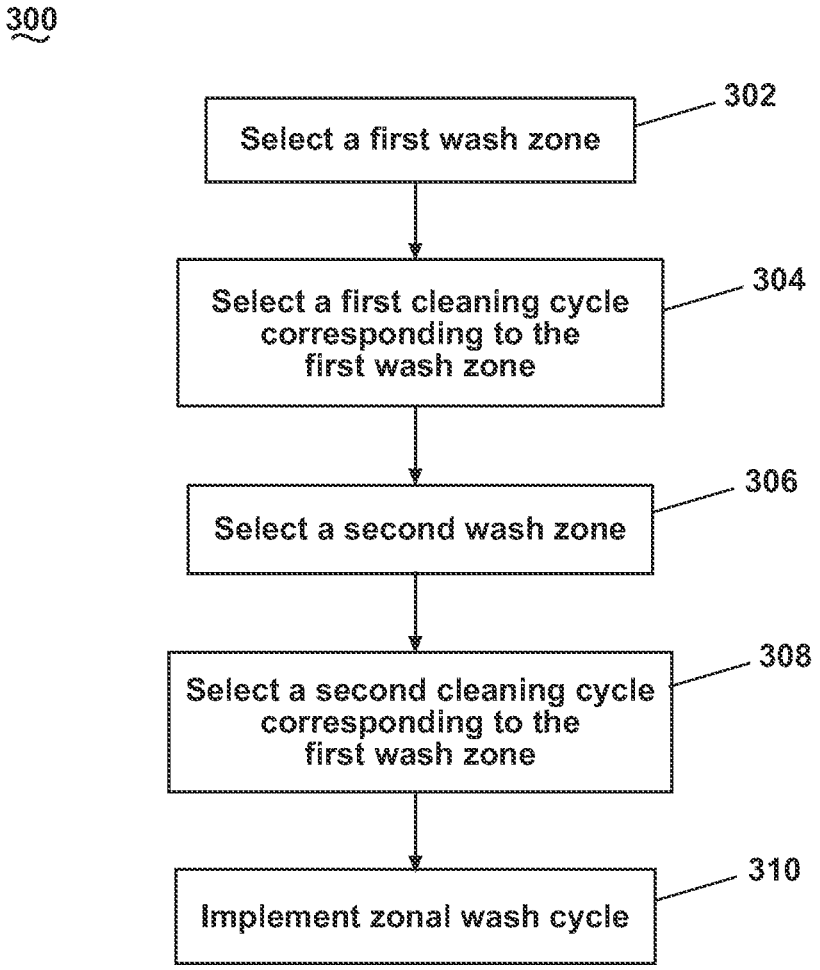
FIG. 13 is a flow chart illustrating a method for operating a dishwasher according to a fourth embodiment of the invention.

FIG. 13 illustrates a method 300 for controlling the operation of the dishwasher 10 to implement a zonal wash cycle according to a fourth embodiment of the invention. The sequence of steps depicted is for illustrative purposes only, and is not meant to limit the method 300 in any way as it is understood that the steps may proceed in a different logical order or additional or intervening steps may be included without detracting from the invention. The method 300 assumes that a user has provided the appropriate treating chemistry or chemistries to the dispensing system 70 and that the user has placed a load of utensils within an area of at least one of the upper and lower racks 24, 26. The method 300 also assumes that the user has defined multiple wash zones using the zonal selector 112, as described above with reference to FIGS. 4-12. These multiple wash zones may have been defined for utensils located in either or both of the upper and lower racks 24, 26.

At 302, the user may select a first wash zone from the multiple wash zones previously defined through the user interface 82 as described in detail above. For example, an input/output screen may be presented to the user, prompting the user to select a predefined zone in the dishwasher 10 where utensils are loaded. At 304, the user may select a first cleaning cycle from the multiple cleaning cycles to be run in the first wash zone. At 306, the user may select a second wash zone, which may be different from the first wash zone, from the multiple wash zones previously defined. At 308, the user may select a second cleaning cycle, which may be different from the first cleaning cycle, from the multiple cleaning cycles to be run in the second wash zone.

At 310 the zonal wash cycle may be implemented. The user may need to take an action, such as by selecting a start button 430 on the user interface 82 (FIG. 14E) to initiate the zonal wash cycle. The zonal wash cycle may be initiated immediately after such selection or at some predetermined time after such selection by the user. The zonal wash cycle may be implemented at 310 by implementing each of the first and second cleaning cycles in the corresponding wash zone during a single cycle of operation of the dishwasher 10. To implement the zonal wash cycle at 310 the first and second cleaning cycles may be concurrently implemented or the first and second cleaning cycles may be sequentially implemented.

Figure 14A:
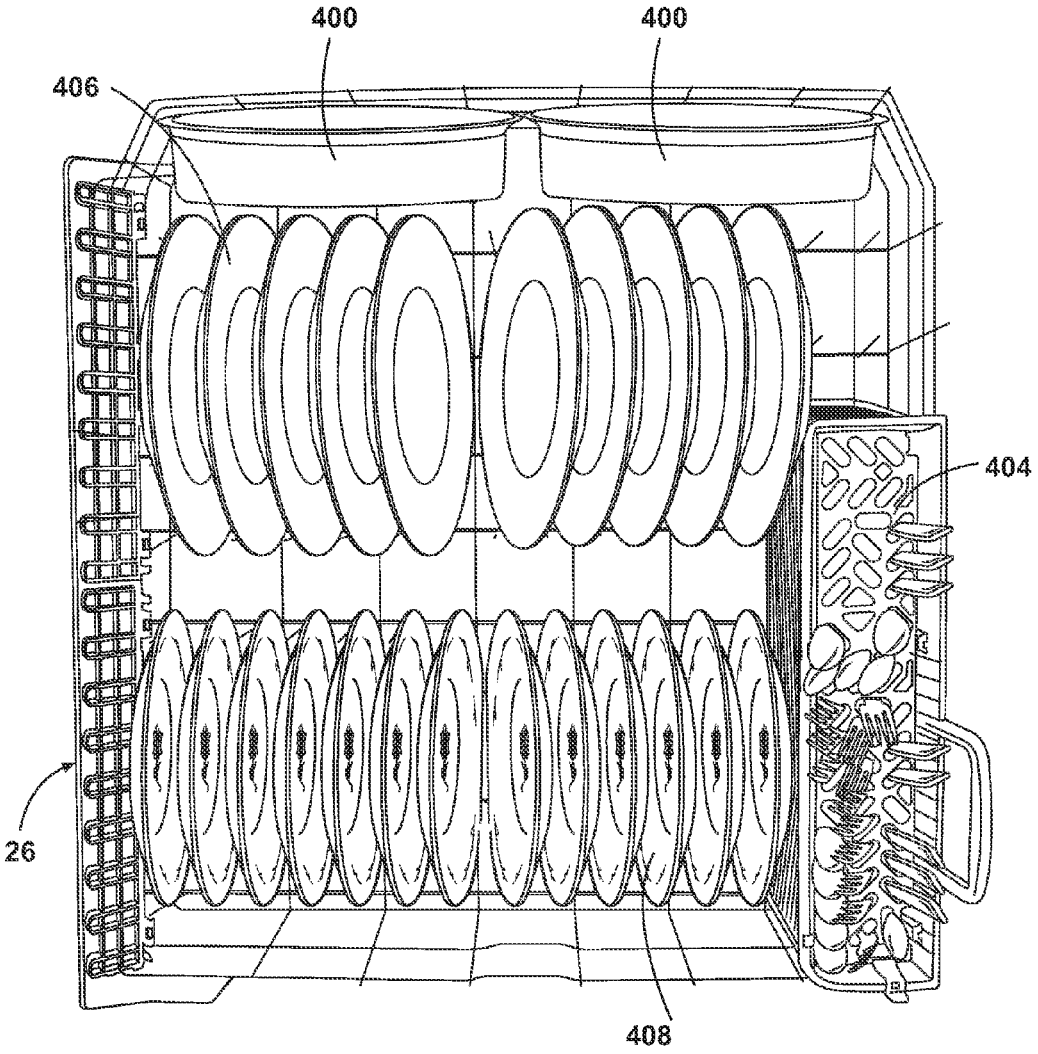
FIG. 14A is a schematic view of the lower rack of the dishwasher of FIG. 2 in which the lower rack has been loaded with utensils.
Figure 14B:
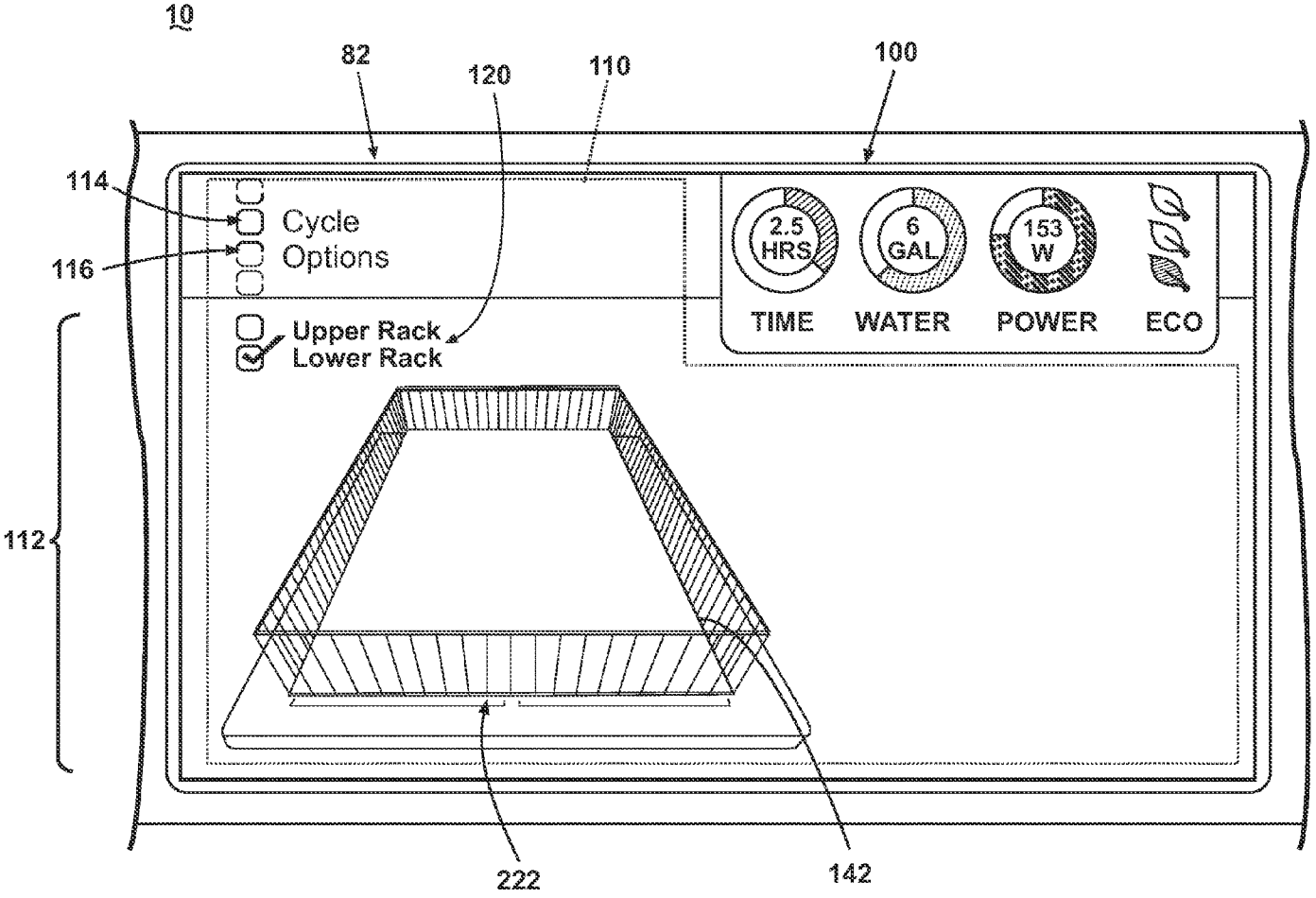
FIGS. 14B-14E are front views of a user interface displaying a rack landscape and illustrating the manipulation of the user interface based on the utensil load of the lower rack from FIG. 14A.

FIGS. 14A-14E illustrate an example of the invention where the operation of the dishwasher 10 may be controlled based on a particular utensil load in the dishwasher 10. While the following example is described in the context of the dishwasher 10 having a rack landscape 222, it may be understood that the example would also pertain to a dishwasher 10 having a rack landscape 122. FIG. 14A illustrates the lower rack 26 of the dishwasher 10 of FIG. 2 which has been loaded by a user with casseroles dishes 400, silverware 404, dinner plates 406, and china 408. With reference to FIG. 14B, once the user has provided the appropriate treating chemistry or chemistries to the dispensing system 70 and closed the door 22, the user may activate the touch screen 100 of the user interface 82 such that the touch screen 100 displays the selection screen 110 including the zonal selector 112, cycle selector 114, and options selector 116. The user may then select the lower rack option using the dish rack selector 120 such that the rack landscape 222 corresponding to the lower rack 26 appears on the touch screen 100.

Figure 14C:
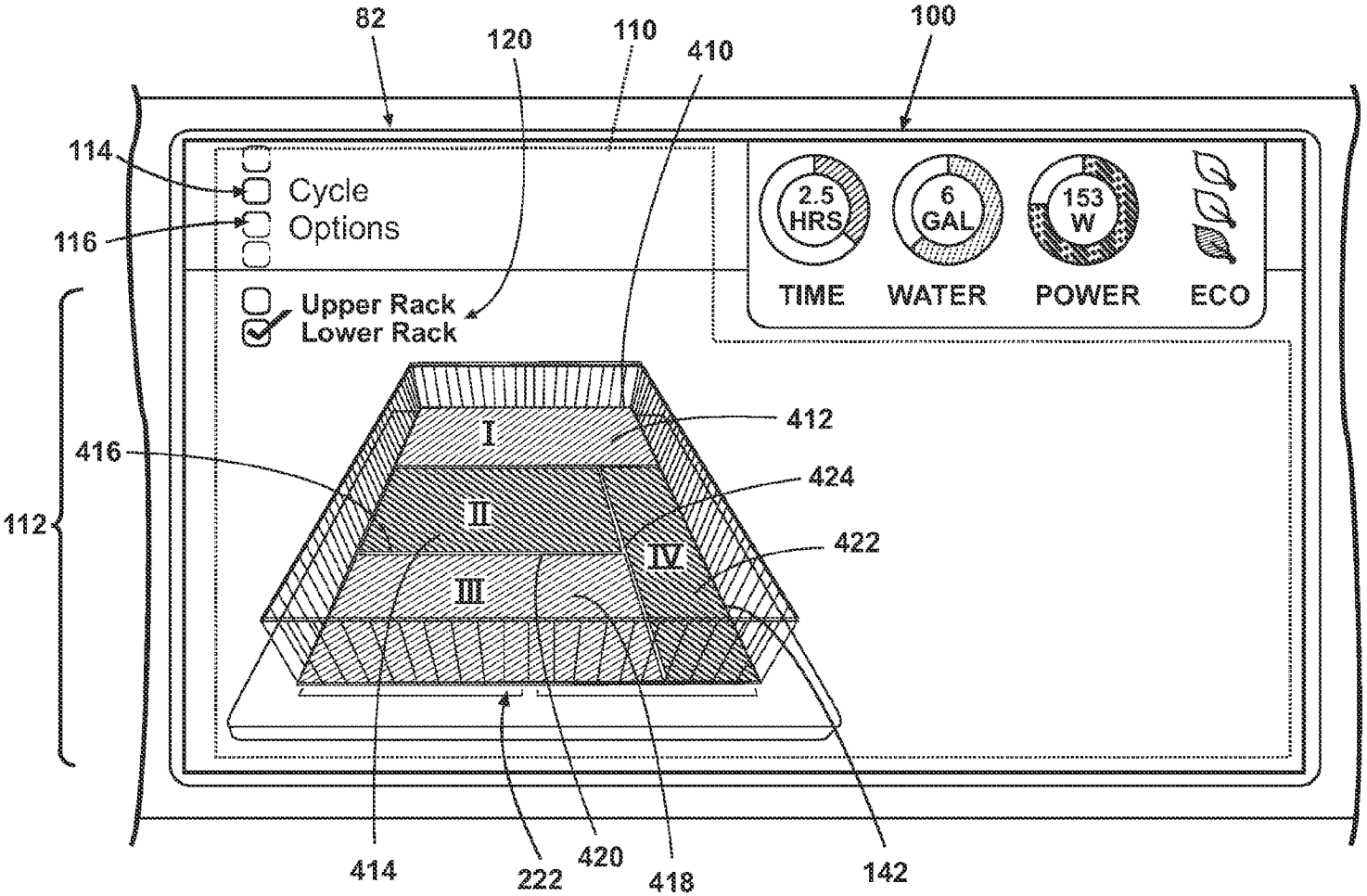

In this example, the touch screen 100 navigates to the corresponding rack landscape 222 and no zones are initially shown on the rack landscapes 222 as illustrated in FIG. 14B. As illustrated in FIG. 14C the user may create zones correlating to the types of dishes loaded into the lower rack 26. For example, the user may draw a boundary line 410 on the rack landscape 222 that correlates to the section of the lower rack 26 where the casserole dishes 400 are located. The boundary line 410 may be drawn by the user contacting the touch screen 100 at an area corresponding to or adjacent to the rack landscape 222 and moving the contact relative to the rack landscape 222 such that a first wash zone 412 may be formed. The user may create a second wash zone 414 on the rack landscape 222 by drawing a boundary line 416 that correlates to the section of the lower rack 26 where the dinner plates 406 are located. The user may create a third wash zone 418 on the rack landscape 222 by drawing a boundary line 420 that correlates to the section of the lower rack 26 where the china 408 has been placed. The user may create a fourth wash zone 422 on the rack landscape 222 by drawing a boundary line 424, which correlates to the section of the lower rack 26 where the silverware 404 have been placed. Alternatively, the controller 80 (FIG. 3) may also be programmed to insert the fourth wash zone 422 in the remainder of the unselected rack landscape 222. Each of the multiple wash zones may be uniquely identified on the user interface such as by a distinct color, pattern, or number. Here they have been identified with roman numerals I-IV.

Figure 14D:
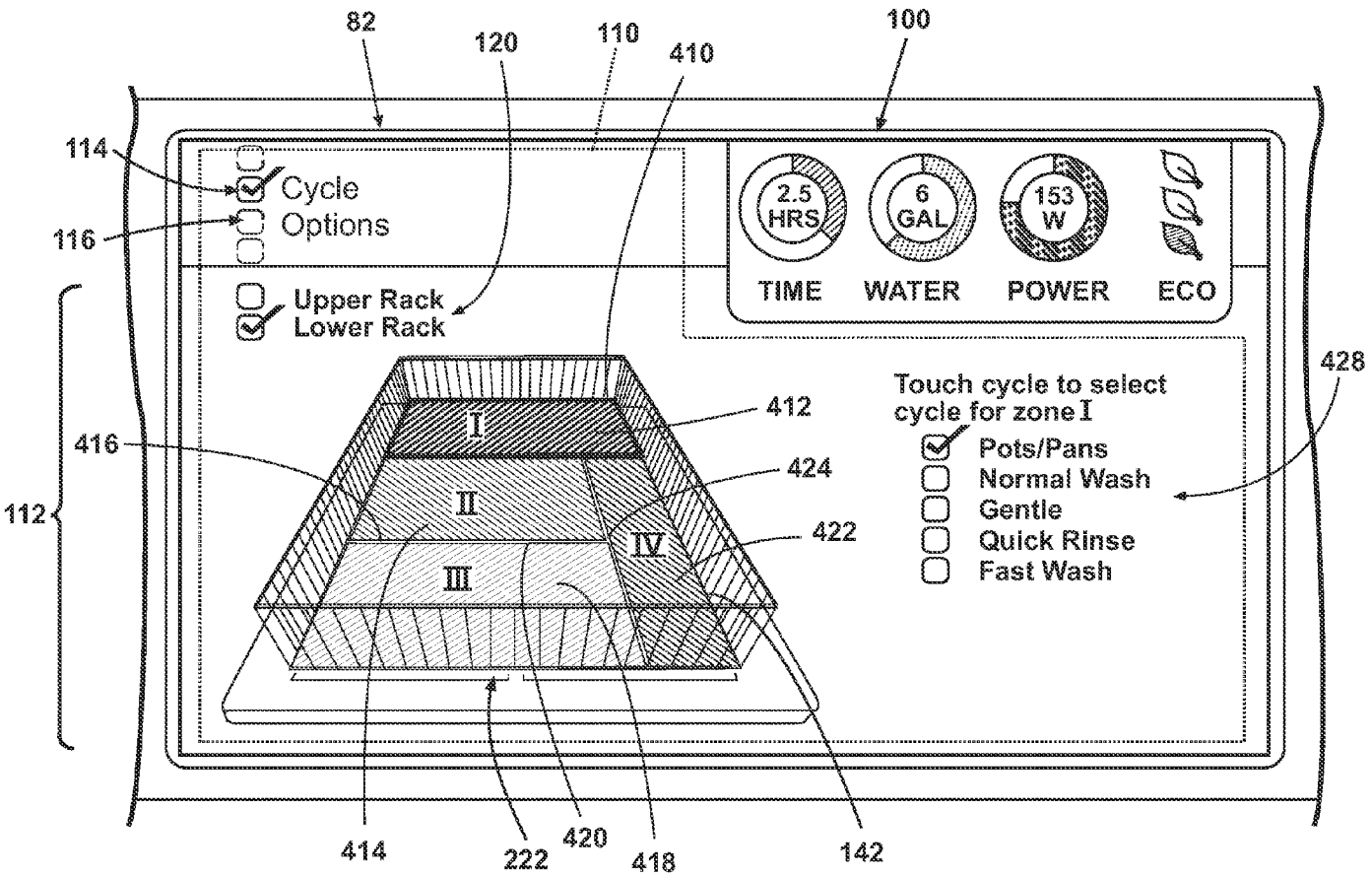

Once all or at least one of the zones 412, 414, 418, 422 have been defined using the zonal selector 112 a user may select one of the zones, such as by the user contacting the touch screen 100 at an area corresponding to or adjacent to the desired zone. For example, FIG. 14D illustrates that a user has selected the first wash zone 412, which may occur by contacting the first wash zone 412, and that the first wash zone 412 illuminates after selection to communicate to the user that it has been selected. Once the first wash zone 412 has been selected, an input/output screen 428 may be presented to the user, prompting the user to select a desired cleaning cycle from a plurality of available user-selectable cycles for the first wash zone 412. As casserole dishes are usually heavily soiled a user would preferably pick the Pots/Pans cycle option for the first wash zone 412.

The user may go on to select a corresponding cleaning cycle for each zone. In this example, the user may select a normal wash for the dinner plates 406 located in the second wash zone 414, a gentle wash for the china 408 located in the third wash zone 418, and a normal wash for the silverware 404 located in the fourth wash zone 422. As the second wash zone 414 and the fourth wash zone 422 have the same cleaning cycle selected the zones 414 and 422 may be linked such that the normal wash cycle may be implemented in both zones as if they were a single zone. Alternatively, the user may opt to link the zones themselves such that only a single cleaning cycle needs to be selected for both zones.

Figure 14E:
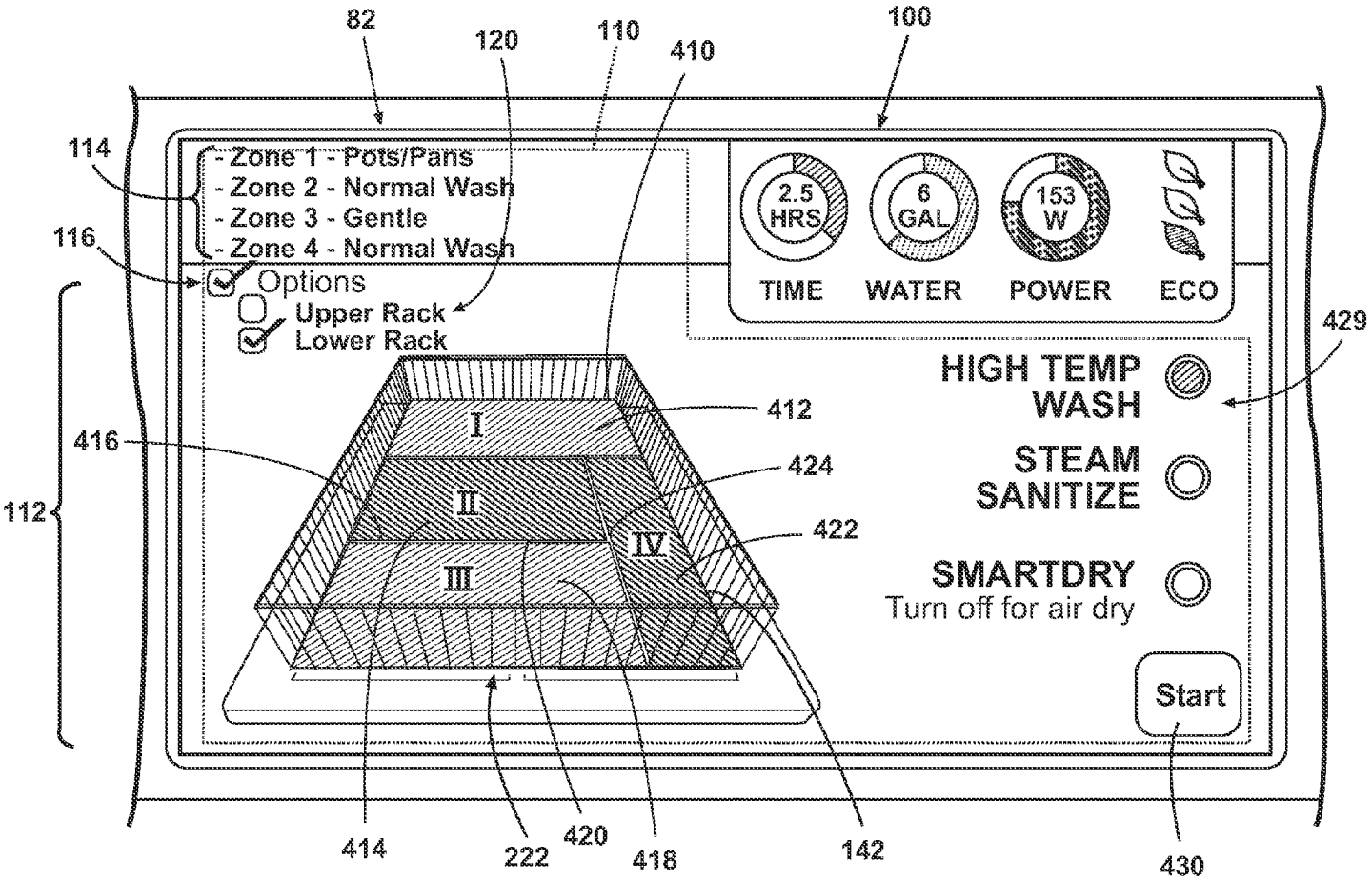

As illustrated in FIG. 14E, the cycle selector 114 portion of the input/output screen may indicate all of the selections for each of the zones. At this point the input/output screen may illustrate any conflicts in the zonal wash cycle. Further, additional input/output screens may be displayed in which the user may modify the selected cleaning cycles by adjusting one or more operating parameters. For example, the user may input a total duration for the zonal wash cycle. As another example, FIG. 14E illustrates the user having selected the option selector 116 using the touch screen 100, which brings up an input/output screen 429 displaying options, and then having selected the high temp wash option on the input/output screen to increase the water temperature during wash portions of the zonal wash cycle. It has been contemplated that such user-defined operating parameters may be saved in the memory 84 (FIG. 3) so that they may be implemented in future zonal wash cycles.

Two different treating chemistries may have been provided within the cups 71 and 72 of the dispensing system 70 (FIG. 1). It has been contemplated that the user interface 82 may be designed such as a user may input information regarding the treating chemistry. For example, the user may indicate that the treating chemistry in cup 71 may be dispensed during the Pots/Pans cycle corresponding to the first wash zone 412 and that the treating chemistry in cup 72 may be dispensed for the remainder of the cleaning cycles. The user may also input characteristics of each treating chemistry, such as the type of treating chemistry that has been provided or the amount of treating chemistry that has been provided. Such information may be used by the controller 80 to properly control the operation of the dishwasher 10. For example, the first treating chemistry may contain bleach which may be deleterious to the enzymes in the second treating chemistry. To ensure that the first treating chemistry does not effect the efficacy of the second treating chemistry, the controller 80 may run the cleaning cycles sequentially instead of concurrently and may flush the dispensing line 79 between cleaning cycles.

After the appropriate cleaning cycles and options have been set and any additional information, such as characteristics of the treating chemistries provided, has been input, the zonal wash cycle may be initiated. A start button 430 may be located on the touch screen 100 for such initiation of the zonal wash cycle. Once initiated by the user, cleaning cycles may be implemented in each of the zones to define the zonal wash cycle.

More specifically, with reference to FIGS. 2 and 14E, during the Pots/Pans cleaning cycle in the first wash zone 412, the controller 80 may operate the components of the dishwasher 10 to dispense a first treating chemistry from the dispensing system 70 and to allow the casserole dishes to receive both the spray wash from the rotatable spray arm 42 of the first lower spray assembly 32, as well as, an additional concentrated spray from the manifold 50 of the second lower spray assembly 34. The controller 80 may even operate to allow some of the spray outlets 30 of the second mid-level spray assembly 38 to spray water into the first wash zone 412. Thus, the controller 80 may operate multiple spray sources and create intersecting sprays that may provide better washing performance for heavily soiled dishes.

Once the Pots/Pans cleaning cycle is complete the controller 80 may then move on to the remaining cleaning cycles. It should be recognized that to take advantage of the different treating chemistries to be dispensed during the zonal wash cycle, the dishwasher 10 may be configured to provide for zone actuation at optimal cycle intervals or may be configured to have an intervening rinse cycle, or may be configured to flush the dispensing line 79 between cleaning cycles.

The normal cleaning cycles in the second and fourth wash zones 414, 422 may be simultaneously run with the gentle cleaning cycle in the third wash zone 418, or the normal and gentle cleaning cycles may be sequentially implemented. If the normal and gentle cleaning cycles are run simultaneously, the controller 80 may operate the components of the dishwasher 10 to dispense a second treating chemistry from the dispensing system 70 and to allow the remaining zones to receive spray from the rotatable spray arm 42 of the first lower spray assembly 32. Furthermore, the intensity of the sprayed liquid may be lowered such that a lighter spray may be sprayed into the third wash zone 418 for the gentle cleaning cycle as compared to the intensity of the spray that may be sprayed into the second wash zone 414 and the fourth wash zone 422 for the normal cleaning cycles. In addition to controlling the intensity of the spray, the rotation of a spray arm may be also be controlled. More specifically, the rate of rotation, the amount of rotation, and the direction of rotation may all be controlled depending on the cleaning cycle being implemented. For example, during the normal cycle the rotatable spray arm 42 may have a dwell time during which the rotatable spray arm 42 is not rotated and water is sprayed onto the utensils.

As another alternative, instead of selecting the type of cleaning cycle (Pots/Pans, normal wash, etc.) the user may be able to input the type of dishes located in each zone. Based upon the types of dishes located in the zone, the cleaning cycle may be automatically selected by the controller 80 to optimize the cleaning performance of the dishwasher 10 for a particular load of utensils in each zone. Furthermore, the sensor 87 (FIG. 3) may determine the presence and quantity of utensils in a particular zone and the controller 80 may auto-select the appropriate cleaning cycle for each zone. Alternatively, a user may be able to input the soil level of the dishes in a particular wash zone and based upon such information, the cleaning cycle may be automatically selected by the controller 80 to optimize the cleaning performance of the dishwasher 10 for the indicated amount of soil on the load of utensils in that zone.

Typical dishwashers do not provide satisfactory control of washing based on load size and dish type. The ability to only select one cycle for a single utensil load may result in using wash cycles that may be inappropriate for part of the utensil load. For example, a "pots and pans" cycle may be suitable for heavily-soiled cooking utensils, but may be overly hot and long for tableware, thereby contributing to excessive water, detergent, and energy consumption. Furthermore, selection of a wash cycle based upon the majority of the utensils in the dishwasher may result in incomplete cleaning of more heavily soiled utensils. The apparatuses and method described above allow a user to designate a wash zone and then select a cleaning cycle appropriate for utensils located in that specific zone. This gives the user more control over how utensils in the dishwasher 10 are washed. In this manner, the dishwasher 10 may provide better washing performance as the dishwasher may increase both efficiency and the cleaning effectiveness of the wash process.

Further, dishwashers that normally spray wash liquid uniformly throughout the wash chamber may result in wash liquid being sprayed in areas that have no utensils if the dishwasher contains less than a full load of utensils. As the apparatus and method described above allow a user to designate which zone may be used during a zonal wash cycle, cleaning and resource usage may be optimized due to the spraying of wash liquid only in areas occupied by utensils. The ability to select which zones will not be used during a zonal wash cycle avoids wasted sprays of water and this saves both time and energy.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims. For example, while the invention is described in the context of a touch screen through which the user may directly interact with the selection screen, it is also within the scope of the invention for the user to interact with the selection screen indirectly using any other suitable type of input mechanism, non-limiting examples of which include a mouse, a track ball, a joystick, a dial and one or more buttons or keys.

What is claimed is:

1. A method of controlling the operation of an automatic dishwasher comprising a wash tub defining a wash chamber, a liquid spraying system defining multiple wash zones within the wash chamber, a controller having three or more cleaning cycles and operably coupled with the liquid spraying system to implement any of the three or more cleaning cycles, and a user interface operably coupled with the controller to provide for input by a user, the method comprising:

receiving from a user an input representative of size and/or shape for multiple user-defined wash zones having a size and/or shape not corresponding to any pre-defined wash zone, wherein the multiple wash zones comprise more than two wash zones;

receiving input for a zonal wash cycle from the user interface to the controller indicating a selection of a first cleaning cycle from the three or more cleaning cycles corresponding to a first wash zone of the multiple wash zones and a second cleaning cycle, different from the first cleaning cycle, from the three or more cleaning cycles corresponding to a second wash zone, different from the first wash zone, of the multiple wash zones; and implementing a zonal wash cycle by implementing each of the first and second cleaning cycles for the corresponding one of the first and second wash zones during a single cycle of operation of the dishwasher to define the zonal wash cycle.

2. The method of claim 1, further comprising uniquely identifying each of the multiple wash zones on the user interface.

3. The method of claim 1 wherein the receiving input further comprises receiving an identification of the type of dishes in at least one of the first and second wash zones.

4. The method of claim 3 wherein the identification of the type of dishes comprises at least part of the indicating a selection.

5. The method of claim 4, further comprising the controller determining at least one of the first and second cleaning cycles based on the identification of the type of dishes for the first and second wash zones, respectively.

6. The method of claim 1 wherein the receiving input comprises indicating whether any of the multiple wash zones is to be used.

7. The method of claim 1 wherein the implementing each of the first and second cleaning cycles comprises concurrently implementing each of the first and second cleaning cycles.

8. The method of claim 1 wherein the implementing each of the first and second cleaning cycles comprises sequentially implementing each of the first and second cleaning cycles.

9. The method of claim 1, further comprising receiving as input a characteristic of a treating chemistry to be used for at least one of the multiple wash zones.

10. The method of claim 9 wherein the characteristic of the treating chemistry comprises at least one of a type and an amount of treating chemistry.

11. The method of claim 1, further comprising receiving as input a duration of at least one of the three or more cleaning cycles.

12. The method of claim 1 wherein the implementing each of the first and second cleaning cycles comprises controlling the rotation of a spray arm relative to the corresponding first and second wash zones.

13. The method of claim 12 wherein the controlling the rotation of the spray arm comprises controlling at least one of: the rate of rotation, the amount of rotation, and the direction of rotation.

14. The method of claim 13 wherein the controlling the rate of rotation includes controlling a dwell time during which the spray arm is not rotated while spraying.

15. The method of claim 1, further comprising visually illustrating the zonal wash cycle on the user interface.

16. The method of claim 15 wherein the visually illustrating the zonal wash cycle is done prior to the implementing of the zonal wash cycle to form a preview of the zonal wash cycle.

17. The method of claim 16 wherein the preview of the zonal wash cycle comprises illustrating any conflicts in the zonal wash cycle.

18. The method of claim 15 wherein the visually illustrating the zonal wash cycle is done during the implementing of the zonal wash cycle to provide an operating status of the zonal wash cycle.

19. The method of claim 1 wherein at least one of the first wash zone and the second wash zone is user defined.

20. The method according to claim 1 wherein the zonal wash cycle comprises operating parameters that are saved in a memory.

21. The method according to claim 20 wherein at least one of the operating parameters is user-defined.

22. The method of claim 1 wherein the implementing the zonal wash cycle comprises spraying liquid into at least one of the first and second wash zones and controlling the intensity of the sprayed liquid.

23. The method of claim 22 wherein the spraying liquid comprises controlling at least one of a rotatable spray arm, a discrete spray nozzle, a translating wash arm, and a fixed spray manifold.

24. The method of claim 22 wherein the spraying liquid comprises controlling multiple spray sources that create intersecting sprays.

25. The method of claim 1 wherein the implementing the zonal wash cycle comprises dispensing a first treating chemistry during at least one of the first and second cleaning cycles.

* * * * *